US006923600B1

(12) United States Patent
Bae

(10) Patent No.: US 6,923,600 B1
(45) Date of Patent: Aug. 2, 2005

(54) METHOD OF REPAIRING AND REINFORCING PIERS USING STONES

(76) Inventor: Suk-Dong Bae, 129-404ho, Siyoung A.P.T. Sinchen-dong, Songpa-Ku, Seoul (KR) 138-795

( * ) Notice: Subject to any disclaimer, the term of this patent is extended or adjusted under 35 U.S.C. 154(b) by 0 days.

(21) Appl. No.: 10/486,176

(22) PCT Filed: Aug. 7, 2002

(86) PCT No.: PCT/KR02/01505

§ 371 (c)(1),
(2), (4) Date: Feb. 6, 2004

(87) PCT Pub. No.: WO03/014476

PCT Pub. Date: Feb. 20, 2003

(30) Foreign Application Priority Data

Aug. 7, 2001 (KR) ..... 2001-47429

(51) Int. Cl.[7] ..... E02D 13/00; E02D 7/00

(52) U.S. Cl. ..... 405/249; 405/136; 405/151; 405/153; 405/232; 405/233; 405/257; 52/745.18; 249/48; 249/209

(58) Field of Search ..... 405/134–136, 405/151–153, 231–233, 251, 249, 257; 52/169.13, 52/169.9, 745.18, 745.17; 249/34, 48, 49, 249/209, 219.1

(56) References Cited

U.S. PATENT DOCUMENTS 413,384 A * 10/1889 Beecher ..... 405/137
1,552,334 A * 9/1925 Mosher ..... 249/219.1
1,947,413 A * 2/1934 Hay ..... 249/48
3,695,044 A * 10/1972 Hoshino et al. ..... 405/153
3,707,846 A * 1/1973 Leblond et al. ..... 405/152
3,816,154 A * 6/1974 Baldyga et al. ..... 106/482
3,946,567 A * 3/1976 Oger ..... 405/153
5,032,197 A * 7/1991 Trimble ..... 156/71
5,044,601 A * 9/1991 Miller ..... 249/219.1
5,255,888 A * 10/1993 Workman ..... 249/48
6,419,204 B1 * 7/2002 Flathau ..... 249/48
2002/0170264 A1 * 11/2002 Koszo ..... 249/48

FOREIGN PATENT DOCUMENTS

| | | | | |
|---|---|---|---|---|
| GB | 2167796 | * | 6/1986 | |
| JP | 06146232 | * | 5/1994 | ..... 405/228 |
| JP | 11200369 | * | 7/1999 | |
| JP | 11241314 | | 9/1999 | |
| KR | 2000012299 | | 3/2000 | |
| KR | 2001054812 | * | 7/2001 | |
| KR | 2001099341 | * | 11/2001 | |
| KR | 2003006236 | * | 1/2003 | |

* cited by examiner

*Primary Examiner*—Jong-Suk (James) Lee
(74) *Attorney, Agent, or Firm*—Kramer & Amado, P.C.

(57) ABSTRACT

A method of repairing and reinforcing a pier using stones. The method includes installing a watertight caisson around a pier and removing water from the gap between the caisson and pier prior to repairing the pier. The method can also include removing impurities from the pier's surface; arraying a plurality of reinforcing steel bars around the pier; laying stones outside the arrayed steel bars while fixing the stones to the steel bars or the pier, and filling the gap between the pier and the stones with concrete.

3 Claims, 6 Drawing Sheets

METHOD OF REPAIRING AND REINFORCING PIERS USING STONES

BACKGROUND OF THE INVENTION

1. Field of the Invention

The present invention relates to a method of repairing and reinforcing a pier and, more particularly, to a method, comprising the steps of installing watertight caisson around a pier, and removing water from the gap between the caisson and pier prior to repairing the pier, further comprises the steps of: removing impurities from the pier's surface; arraying a plurality of reinforcing steel bars around the pier; laying stones outside the arrayed steel bars while fixing the stones to the steel bars or the pier, and filling the gap between the pier and the stones with concrete.

2. Description of the Prior Art

In general, a pier should be reinforced immediately when the strength of covered concrete weakened by freezing or melting, corrosion of an iron reinforcement rod occurs due to separation of material and lack of covering, abrasion and erosion by collision with conveying material and whirlpool, neutralization of concrete is founded.

The method to repair and reinforce the said pier has been usually performed in the under water but lately worked in a dry condition by installing water tight caisson around piers presented by present inventor.

As shown in the FIG. 1, The method to repair and reinforce the said pier is that install water tight caisson (101) around the pier (100), remove water from the gap between water tight caisson (101) and the pier (100), worker (102) comes down through the wire (103) and then fill damaged part with concrete.

However, the prior art to repair and reinforce the said pier has some problems such as spots resulting from partial repairing of the pier (100), partial separation or erosion by the lack of adhesiveness with a concrete, and still the repaired pier immersed in the water after repairing.

DISCLOSURE OF THE INVENTION

To alleviate the problems of the prior art as described above, it is an object of the present invention to provide a method of repairing and reinforcing a pier using such stones which could repair not on the part of the pier but the entire pier and keep the concrete from water after repairing.

The present invention is characterized in the method of comprising the steps of: installing a watertight caisson around a pier, and removing water from the gap between the caisson and pier prior to repairing the pier, and then, in addition to the said well known method of repairing and reinforcing a pier, removing impurities from the pier's surface; arraying a plurality of reinforcing steel bars around the pier; laying stones outside the arrayed steel bars while fixing the stones to the steel bars or the pier, and filling the gap between the pier and the stones with concrete.

Therefore, the present invention effectively repairs and reinforces the piers in a good appearance with one time job, and protecting the concrete and steel bars for a desired lengthy period of time and no need additional repairing or reinforcing.

DESCRIPTION OF THE REFERENCE NUMERALS IN THE DRAWINGS

| | | |
|---|---|---|
| 10: pier | 11: watertight caisson | 12: stone |
| 13: steel bar | 14, 15, 18: anchor bolt | 16, 19: connection pin |
| 17: angle | 20: concrete | 21: watertight tube |
| 22: Blast tank | 23: support bar | |

BEST MODE FOR CARRYING OUT THE INVENTION

Figure 1:
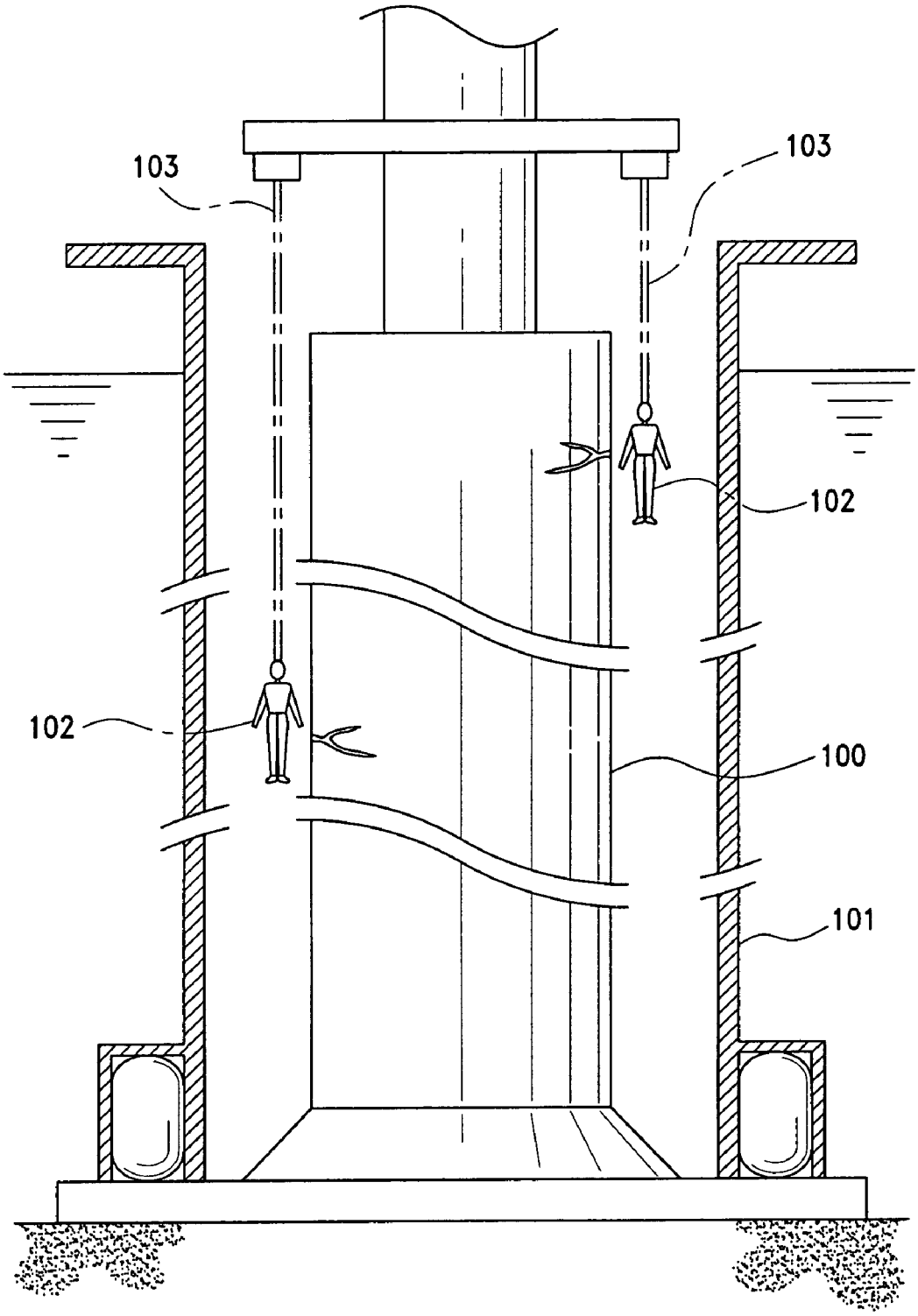
FIG. 1 is a configuration showing a conventional process of repairing and reinforcing a pier.
Figure 2:
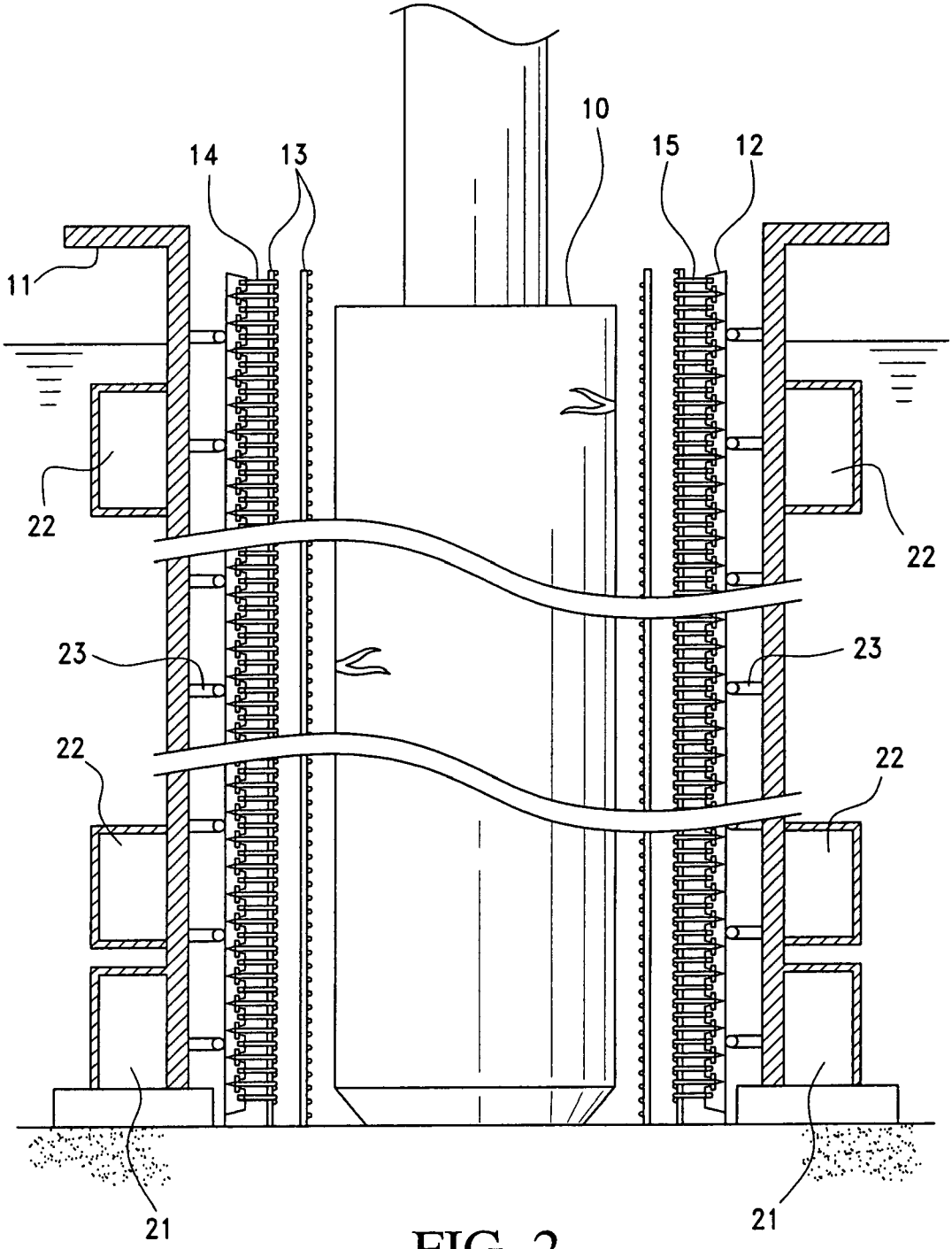
FIG. 2 is a configuration, showing a process of repairing and reinforcing a pier in the present invention.

The above objects, features and functions of the present invention will be more clearly understood from the following detailed description taken in conjunction with the accompanying drawings, in which:

FIG. 2 is a configuration, showing a process of repairing and reinforcing a pier in the present invention.

Figure 3:
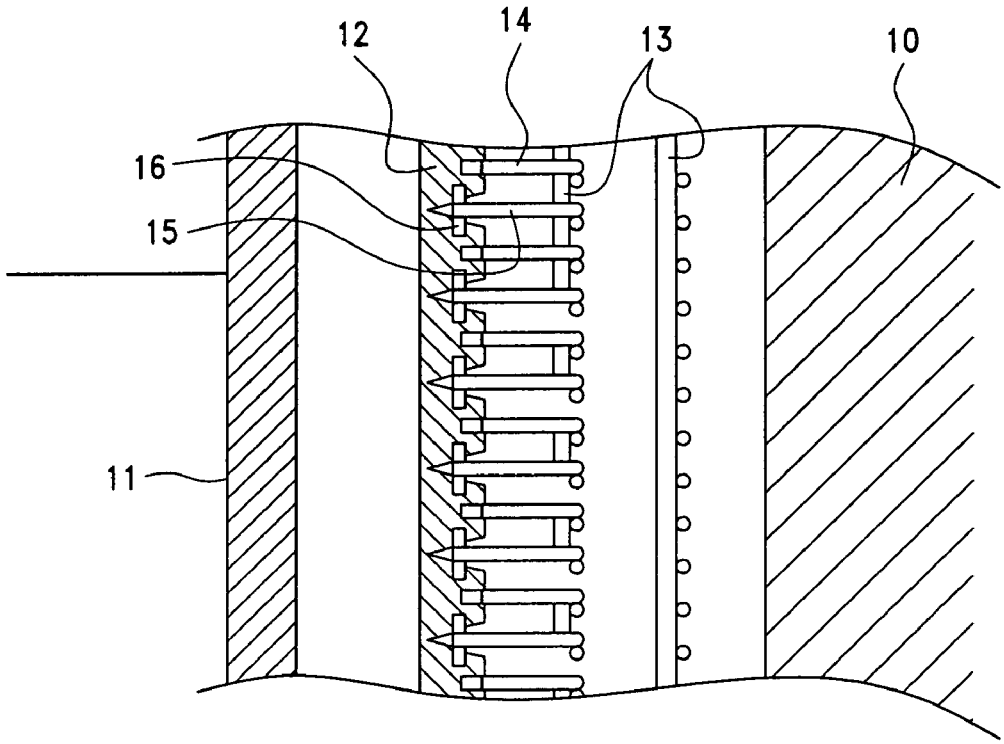
FIG. 3 is a magnified sectional view in the part of FIG. 2.

FIG. 3 is a magnified sectional view in the part of FIG. 2.

Figure 4:
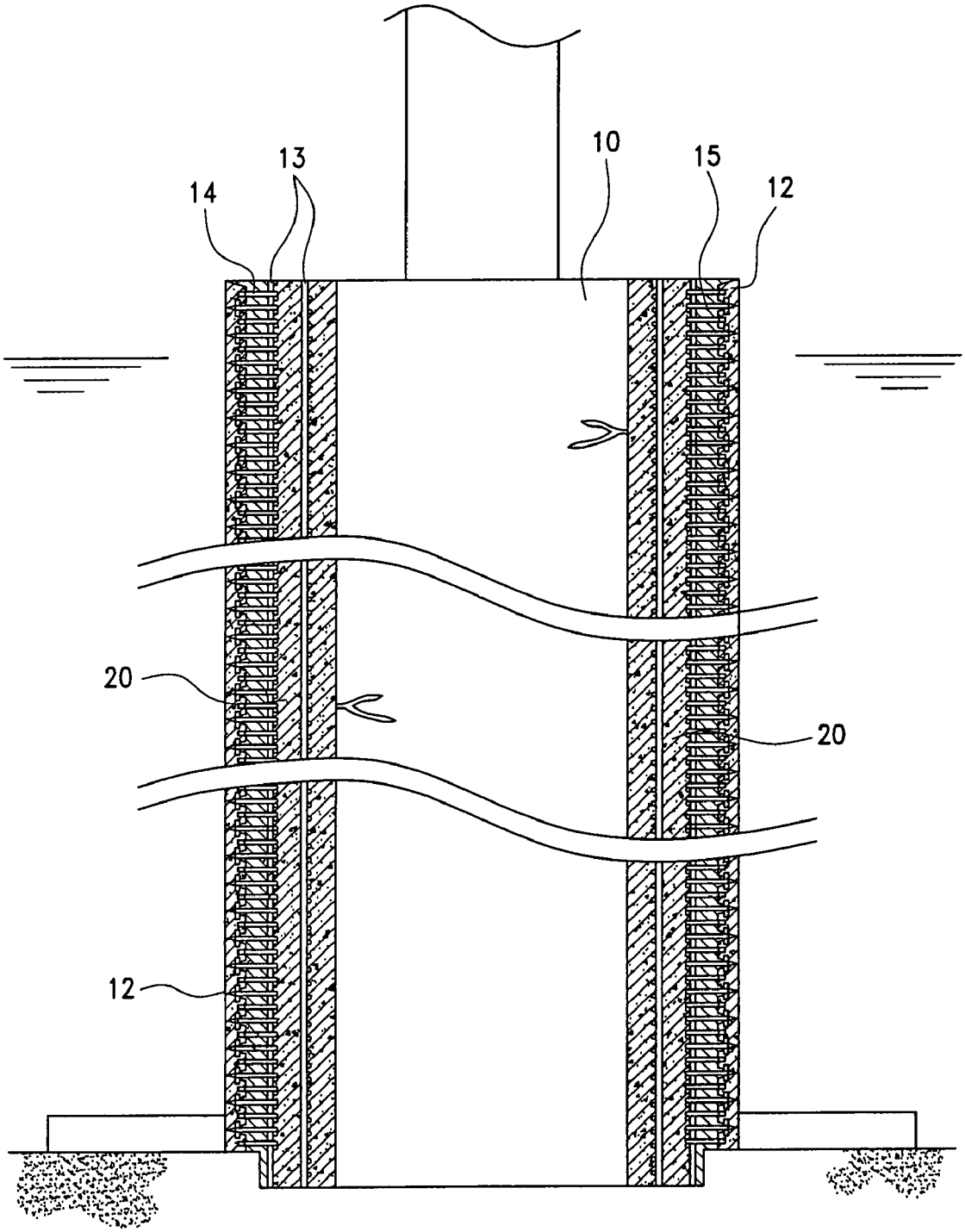
FIG. 4 is a sectional view showing the state of repairing and reinforcing a pier in the present invention.

FIG. 4 is a sectional view showing the state of repairing and reinforcing a pier in the present invention.

Figure 5:
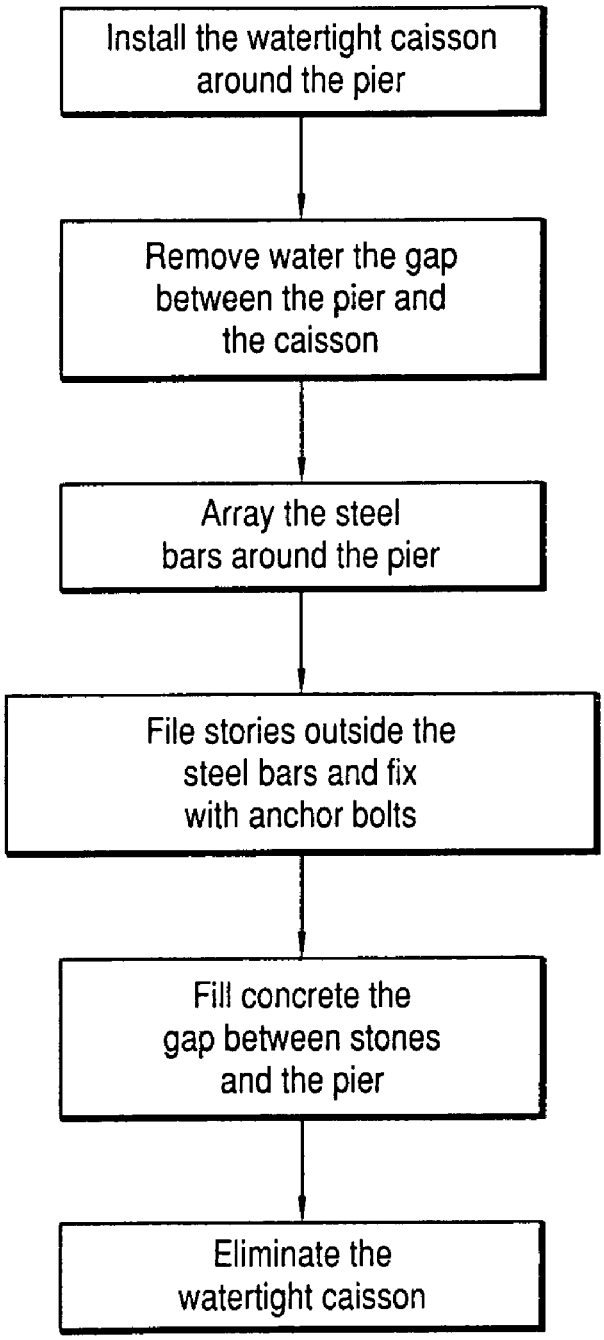
FIG. 5 is a drawing showing the process of repairing and reinforcing a pier in the present invention.

FIG. 5 is a drawing showing the process of repairing and reinforcing a pier in the present invention.

When the damaged pier is found, assembling a watertight caisson (11) on the water, comprising of watertight tube (21), Blast tank (22) and support bar (23), around the pier, installing it closely on the floor and wall of the pier, eliminating water from the gap between the watertight caisson (11) and the pier (10) for a worker to do work.

Removing impurities from the pier (10)'s surface, arraying a plurality of reinforcing steel bars (13) around the pier, laying stones (12) outside the arrayed steel bars (13) while fixing the stones (12) to the steel bars with anchor bolt (14, 15). The said anchor bolts (14, 15) are made up anchor bolt (14) having a ring type in one side and another anchor bolt (15) having connection pin (16) vertically installed. So one side of anchor bolt (14) hangs up to the steel bar (13) and the other side of anchor bolt is fixed in the middle of the stone (12).

Also anchor bolt (15) having a connection pin (16) is fixed to the steel bar (13) and top and bottom of connection pin (16) in other side is fixed to upper and lower part of stones, respectively. The next step is filling the gap between the pier (10) and the stones (12) with concrete and finally removing the watertight caisson (11).

By repairing and reinforcing the pier (10) following the said work process, the installed stones, themselves, improve the appearance of the pier (10) and it protects the concrete and steel bars for a lengthy period of time, and are not easily corroded.

Figure 6:
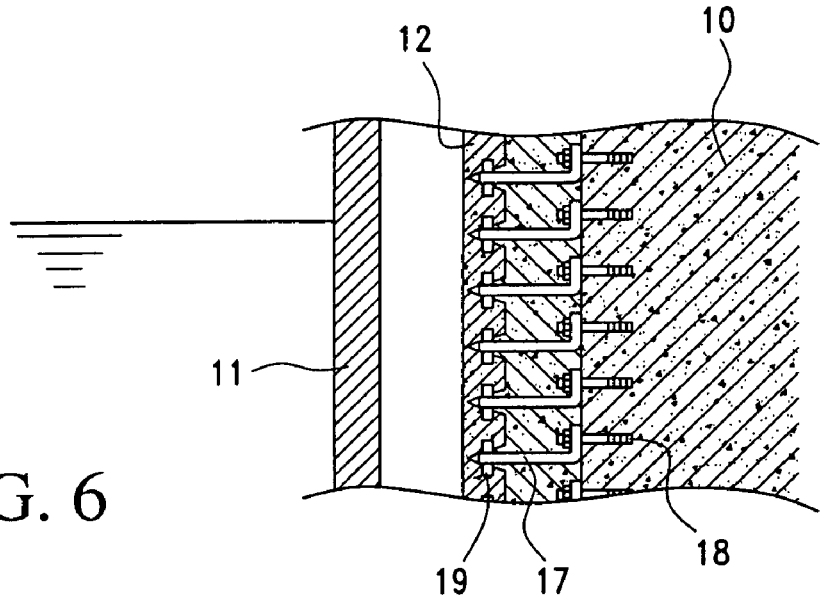
FIG. 6 is a configuration, showing a process of repairing and reinforcing a pier for another example in the present invention.

Meanwhile, FIG. 6 shows one of examples which describe how to fix the stones (12) in the process of repairing and reinforcing the pier in the present invention. Connection pin (19) is vertically installed in one end and anchor bolt (18) is in the other end. Angle (17) which is made up by bending inside part of the installed anchor bolt (18), so the anchor bolt (18) is installed and fixed on the pier (10) and thus the top and bottom of connection pin (19) is fixed to lower part and upper part of stones (12), respectively.

In this kind of another example for repairing the damaged pier, since the gap between the pier (10) and stones (12) is narrow, no reinforcing steel bars (13) are needed and thus the said repairing work is easier and more economical.

Figure 7:
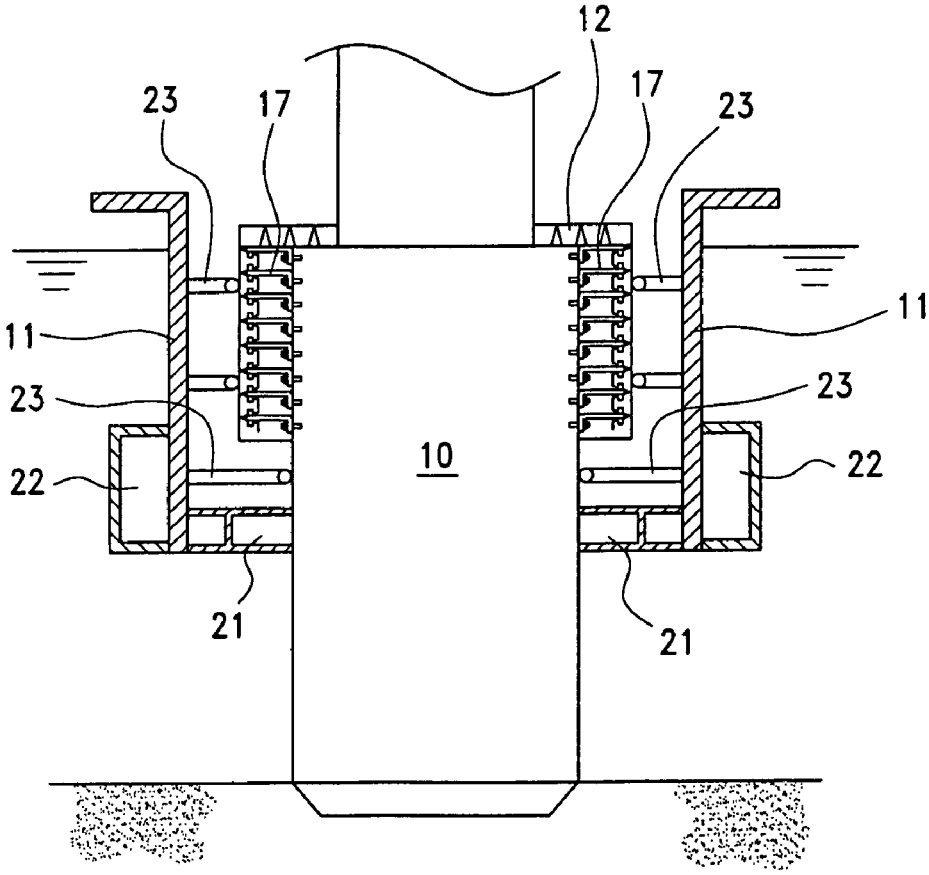
FIG. 7 is a configuration, showing a process of repairing and reinforcing a pier for another example in the present invention.

FIG. 7 shows the work process of repairing and reinforcing the pier with a lower cost and within a shorter work period, in case of the upper part of the pier damaged or in order to make the outlook of pier graceful. The lower part of the watertight caisson (11) is installed in the middle of the pier (10) and removed water between the watertight caisson (11) and the pier (10), so the worker can go down to work.

In the example and another example, only the repairing and reinforcing the pier (10) is described but it can be applied to newly installing piers with a strong synthetic resin or other excellent materials having durable or anti-corrosive properties instead of stones (12).

INDUSTRIAL APPLICABILITY

As described above, the present invention provides a method of repairing and reinforcing a pier which improves the appearance of the pier and resists the corrosion and so does not need additional repairing for a desired lengthy period of time.

What is claimed is:

1. A method of repairing and reinforcing a pier using stones, comprising the steps of: installing a water tight caisson (11) around the pier (10); removing water from the gap between the watertight caisson (11) and the pier (10) arraying a plurality of reinforcing steel bars (13) around the pier (10); laying stones (12) outside the arrayed steel bars (13) while fixing the stones (12) to the steel bars (13) or the pier (10); filling a gap between the pier (10) and the stones (12) with concrete; and eliminating the watertight caisson (11).

2. The method according to claim 1, further comprising fixing the stones with an anchor bolt wherein the anchor bolt (14) has a ring in one side to fix a steel bar (13) and to lock in a middle of an inside of a stone (12) and another anchor bolt (15) has a ring in one side to fix on the steel bar (13) and another side has a connection pin (16) vertically installed to lock a lower and an upper part of stones (12).

3. The method according to claim 1, further comprising fixing the stones (12) with an angle (17) wherein an anchor bolt (18) is fixed to one end of the angle (17) and a connection pin (19) is vertically installed in another end of angle (17), whereby the stones (12) located on a top and a bottom of the angle (17) are fixed.

* * * * *